US012410489B2

(12) United States Patent
Yang et al.

(10) Patent No.: US 12,410,489 B2
(45) Date of Patent: Sep. 9, 2025

(54) WIRE ROD FOR HIGH-STRENGTH STEEL FIBER, HIGH-STRENGTH STEEL FIBER, AND METHOD FOR MANUFACTURING SAME

(71) Applicant: POSCO, Pohang-si (KR)

(72) Inventors: Yo-Sep Yang, Seoul (KR); Manjae Lee, Pohang-si (KR); Yong-Sik Park, Pohang-si (KR)

(73) Assignee: POSCO, Pohang-si (KR)

( * ) Notice: Subject to any disclaimer, the term of this patent is extended or adjusted under 35 U.S.C. 154(b) by 493 days.

(21) Appl. No.: 17/786,511

(22) PCT Filed: Nov. 6, 2020

(86) PCT No.: PCT/KR2020/015532

§ 371 (c)(1),
(2) Date: Jun. 16, 2022

(87) PCT Pub. No.: WO2021/125554

PCT Pub. Date: Jun. 24, 2021

(65) Prior Publication Data

US 2023/0031552 A1 Feb. 2, 2023

(30) Foreign Application Priority Data

Dec. 20, 2019 (KR) ..... 10-2019-0171698

(51) Int. Cl.
*C21D 8/06* (2006.01)
*B21B 1/16* (2006.01)
(Continued)

(52) U.S. Cl.
CPC ..... *C21D 8/065* (2013.01); *B21B 1/16* (2013.01); *B21C 1/02* (2013.01); *C21D 9/525* (2013.01);
(Continued)

(58) Field of Classification Search
CPC ..... C21D 8/06–065
See application file for complete search history.

(56) References Cited

U.S. PATENT DOCUMENTS 6,162,389 A * 12/2000 Hase ..... C22C 38/16 420/92
6,635,129 B1 * 10/2003 Nagahama ..... C21D 9/525 148/579
(Continued)

FOREIGN PATENT DOCUMENTS

CN 1251865 A 5/2000
CN 1386143 A 12/2002
(Continued)

OTHER PUBLICATIONS

International Search Report issued in corresponding International Application No. PCT/KR2020/015532 dated Jun. 4, 2021.
(Continued)

*Primary Examiner* — Sally A Merkling
*Assistant Examiner* — Austin Pollock
(74) *Attorney, Agent, or Firm* — Morgan Lewis & Bockius LLP

(57) ABSTRACT

Disclosed are a wire rod for a steel fiber having a strength of 1,500 MPa or more without performing LP heat treatment during a wire drawing process, a steel fiber and, a method for manufacturing the same. The wire rod for a high-strength steel fiber according to the present disclosure includes, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, wherein a microstructure is single-phase ferrite.

8 Claims, 1 Drawing Sheet

(51) Int. Cl.

| | |
|---|---|
| ***B21C 1/02*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C21D 2211/005* (2013.01)

(56) References Cited

U.S. PATENT DOCUMENTS

| | | | | |
|---|---|---|---|---|
| 11,427,901 | B2 * | 8/2022 | Imanami | C22C 38/24 |
| 2003/0131909 | A1 * | 7/2003 | Yoshinaga | C22C 38/004 72/370.14 |
| 2006/0065335 | A1 * | 3/2006 | Mizutani | C22C 38/06 148/654 |
| 2017/0162306 | A1 * | 6/2017 | Masumoto | C22C 38/60 |

FOREIGN PATENT DOCUMENTS

| | | | | | |
|---|---|---|---|---|---|
| CN | 105149811 | A | * | 12/2015 | B23K 35/3073 |
| CN | 105401074 | A | | 3/2016 | |
| CN | 108220773 | A | | 6/2018 | |
| JP | 10306345 | A | * | 11/1998 | |
| JP | 2000-008140 | A | | 1/2000 | |
| JP | 2006152406 | A | * | 6/2006 | |
| JP | 2007-284774 | A | | 11/2007 | |
| JP | 2009174006 | A | * | 8/2009 | |
| JP | 2009275250 | A | * | 11/2009 | |
| JP | 2011184717 | A | * | 9/2011 | |
| JP | 2012062503 | A | * | 3/2012 | |
| JP | 2014-208901 | A | | 11/2014 | |
| JP | 2017066431 | A | * | 4/2017 | B23K 35/3073 |
| JP | 2017-106099 | A | | 6/2017 | |
| JP | 2018197375 | A | * | 12/2018 | |
| KR | 10-0708430 | B1 | | 4/2007 | |
| KR | 10-2013-0140205 | A | | 12/2013 | |
| KR | 10-2016-0082363 | A | | 7/2016 | |
| KR | 10-2016-0082608 | A | | 7/2016 | |
| KR | 10-2016-0083263 | A | | 7/2016 | |
| KR | 2016082363 | A | * | 7/2016 | |
| KR | 10-2017-0022890 | A | | 3/2017 | |
| KR | 10-1819371 | B1 | | 1/2018 | |
| KR | 10-2019-0077772 | A | | 7/2019 | |
| KR | 10-2019-0078210 | A | | 7/2019 | |
| KR | 2019076694 | A | * | 7/2019 | C21D 8/06 |
| KR | 10-2019-0123303 | A | | 10/2019 | |
| WO | WO-2017094446 | A1 | * | 6/2017 | |

OTHER PUBLICATIONS

Notice of Allowance issued in corresponding Korean Patent Application No. 10-2019-0171698 dated Aug. 4, 2021.
Office Action issued in corresponding Korean Patent Application No. 10-2019-0171698 dated May 21, 2021.
Chinese Office Action dated Aug. 23, 2023 issued in Chinese Patent Application No. 202080093191.4 (with English translation).
Partial Supplementary European Search Report dated Nov. 3, 2023 issued in European Patent Application No. 20900918.2.
Office action issued Jan. 10, 2024 for counterpart Chinese Patent Application No. 202080093191.4 (See English Translation).
Extended European Search Report issued Jan. 24, 2024 for European Patent Application No. 20900918.2.
Supplementary European Search Report issued Feb. 13, 2024 for European Patent Application No. 20900918.2.
Chinese Office Action dated Feb. 22, 2023 issued in Chinese Patent Application No. 202080093191.4 (with English translation).

* cited by examiner

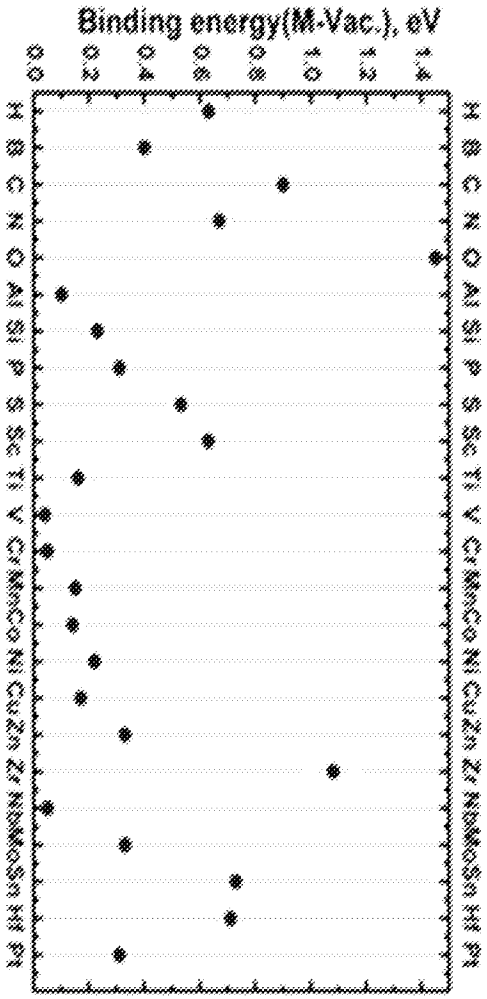
Binding energy(M-Vac-), eV
0.0
0.2
0.4
0.6
0.8
1.0
1.2
1.4
H B C N O Al Si P S Sc Ti V Cr Mn Co Ni Cu Zn Zr Nb Mo Sn Hf Pt

WIRE ROD FOR HIGH-STRENGTH STEEL FIBER, HIGH-STRENGTH STEEL FIBER, AND METHOD FOR MANUFACTURING SAME

CROSS REFERENCE

This application is the U.S. National Phase under 35 U.S.C. § 371 of International Application No. PCT/KR2020/015532 filed on Nov. 6, 2020, which claims the benefit of Korean Patent Application No. 10-2019-0171698 filed on Dec. 20, 2019, the entire contents of each are hereby incorporated by reference.

TECHNICAL FIELD

The present disclosure relates to a wire rod for a high-strength steel fiber, a high-strength steel fiber, and a method for manufacturing the same, and more particularly, to a wire rod for a steel fiber having a tensile strength of 1,500 MPa or more without performing LP heat treatment during drawing, a steel fiber and, a method for manufacturing the same.

BACKGROUND ART

To be used as steel fibers, flexural properties are required for final formation but a property preferentially required is strength. Although mild steel wires having a tensile strength of 1,000 to 1,100 MPa has been required until now, the demand for high-strength steel fibers having a tensile strength of 1,500 MPa or more is increasing as the New Austrian Tunneling Method (NATM) has drawn considerable attention instead of the blasting methods.

As methods for increasing strength in carbon steels, a method of obtaining strength by reducing grain size in accordance with Hall-Petch Eq. and a method of obtaining strength by applying a processing amount has been used. Particularly, a method of increasing strength by a drawing process is the most economical and effective method.

Meanwhile, when a microstructure of a wire rod consists only of pearlite, strength exponentially increases during a drawing process. This is because, although cementite inside pearlite undergoes plastic deformation, strength is increased by binding between carbon and dislocation caused by decomposition of cementite. However, in the case where pearlite and ferrite coexist or a ferrite fraction is greater than a pearlite fraction, there is a problem of occurrence of fracture during a drawing process because pearlite is a relatively hard phase.

Meanwhile, lead patenting (LP) heat treatment, which has been conducted before a drawing process to impart ductility materials, is a cause of increasing manufacturing costs because a lot of costs and time are required for the heat treatment. Therefore, steel fiber manufacturers tend to omit the LP heat treatment, if possible, and it is difficult to introduce high carbon steel that forms pearlite causing facture during a drawing process.

Therefore, there is a need to develop a wire rod for a steel fiber having a low C content manufactured by omitting an additional LP heat treatment process and a method for manufacturing the same.

DISCLOSURE

Technical Problem

Provided are a wire rod for a steel fiber having strength while reducing a C content, a steel fiber, and a method for manufacturing the same.

Technical Solution

In accordance with an aspect of the present disclosure to achieve the above-described objects, provided is a wire rod for a high-strength steel fiber including, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, wherein a microstructure is single-phase ferrite.

In addition, according to an embodiment of the present disclosure, in a −D/4 to D/4 range of a transverse cross-section, an area fraction of ferrite having an average grain size greater than 50 μm and high angle grain boundaries having a misorientation angle of 15° or more may be from 60 to 80%. Here, D represents a diameter of the wire rod.

In addition, according to an embodiment of the present disclosure, in a −D/4 to D/4 range of a transverse cross-section, an area fraction of ferrite having an average grain size greater than 50 μm and high angle grain boundaries having a misorientation angle of 15° or more may be 25% or less. Here, D represents a diameter of the wire rod.

In addition, according to an embodiment of the present disclosure, an area fraction of ferrite may be 99.5% or more.

In addition, according to an embodiment of the present disclosure, a tensile strength may be 450 MPa or more.

In accordance with another aspect of the present disclosure, provided is a method for manufacturing a wire rod for a high-strength steel fiber including: preparing a wire rod by maintaining a billet comprising, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, in a furnace in a temperature range of 1,050 to 1,150° C. for 90 to 120 minutes and rolling the billet; coiling the prepared wire rod in a temperature range of 800 to 850° C.; and cooling the wire rod to 400° C. at a rate of 2 to 5° C./sec and cooling the wire rod to a temperature range of 180 to 220° C. at a rate of 20 to 30° C./sec.

In accordance with another aspect of the present disclosure, provided is a high-strength steel fiber including, in percent by weight (wt %), 0.01 to 0.03% of C, 0.1 or less (excluding 0) of Si, 1.0 to 2.0% of Mn, 0.05 to 0.15% of P, 0.01% to 0.05% of Al, 0.01% or less (excluding 0) of N, 0.03% or less (excluding 0) of S, 0.02 to 0.08% of Sn, and the remainder of Fe and inevitable impurities, and having a tensile strength of 1,500 MPa or more.

In addition, according to an embodiment of the present disclosure, based on a length of 100 D, a number of torsions without delamination may be 60 times or more. Here, D represents a diameter of a steel wire.

In addition, according to an embodiment of the present disclosure, an increase in tensile strength after 24 hours of room temperature aging may be 40 MPa or less.

In addition, according to an embodiment of the present disclosure, a reduction in the number of torsions after 24 hours of room temperature aging may be twice or less.

In accordance with another aspect of the present disclosure, provided is a method for manufacturing a high-strength steel fiber including: dry-drawing the wire rod for a high-strength steel fiber according to any one of claims 1 to 4; and wet-drawing the wire rod to a diameter of 0.4 to 1.0 mm, wherein a tensile strength of 1,500 MPa or more is obtained without performing LP heat treatment after the dry-drawing and before the wet-drawing.

Advantageous Effects

In the case where a steel wire for a steel fiber is manufactured using the wire rod for a steel fiber according to the present disclosure, a strength of 1,500 MPa or more may be obtained even with a low C content and the LP heat treatment, which is a process of recovering ductility during a drawing process, may be omitted, and thus manufacturing costs may be reduced.

In addition, tunnels may be constructed using the NATM without using the conventional blasting method in the case of using a high-strength steel fiber reinforcing concrete according to the present disclosure, and effects on preventing tunnel collapse and improving lifetime of tunnels may be expected.

DESCRIPTION OF DRAWINGS

FIG. 1 is a graph illustrating binding energy of each alloying element with dislocation.

BEST MODE

A wire rod for a high-strength steel fiber according to an embodiment of the present disclosure includes, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, wherein a microstructure is single-phase ferrite.

MODES OF THE INVENTION

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

Throughout the specification, the term "include" an element does not preclude other elements but may further include another element, unless otherwise stated.

As used herein, the singular forms are intended to include the plural forms as well, unless the context clearly indicates otherwise.

In the manufacture of a concrete reinforcing steel fiber used in tunnel construction, it is important to lower the C content for inhibiting formation of a pearlite structure, which is a hard phase and solve problems caused by the lowered C content.

The present inventors have found that a final steel wire may have a tensile strength of 1,500 MPa or more by performing a drawing process, in which the C content is controlled to a very low level to inhibit formation of pearlite causing fracture during the drawing process, the P content is increased to obtain strength, and Sn is added to inhibit dynamic and static aging, without performing additional LP heat treatment, thereby completing the present disclosure.

In the present disclosure, the C content is controlled to 0.03% or less to inhibit formation of pearlite that causes fracture during a drawing process and to construct ferrite, as a relatively soft phase, as a main structure.

A strength of about 100 MPa may be improved by increasing the C content and the N content by 0.1%, respectively, and a strength of about 80 MPa may be improved by increasing the P content by 0.1%. Therefore, in the present disclosure, in order to prepare a high-strength steel fiber, attempts have been made to obtain strength by introducing the solid solution strengthening effect using P in a state where the microstructure is fully composed of ferrite.

Meanwhile, a density of dislocation formed in a ferrite structure during a drawing process is $10^{15}$ /nm$^2$ or more. Dislocation binds to interstitial elements, i.e., C and N, to increase strength, thereby deteriorating ductility, which may cause a problem of occurrence of fracture during the drawing process.

FIG. 1 is a graph illustrating binding energy of each alloying element with dislocation. Referring to FIG. 1, Sn having a binding strength to dislocation as high as that of Hf may prevent binding of N to dislocation. In the present disclosure, by inhibiting an increase in strength caused by dynamic and static aging by optimizing the Sn content, a drawing limit is increased without performing the LP heat treatment that is a process of recovering ductility.

A wire rod for a high-strength steel fiber according to an embodiment of the present disclosure, includes, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities.

Hereinafter, roles and contents of alloying elements contained in the wire rod according to the present disclosure will be described. The % for each alloying element refers to wt %.

The content of C is from 0.01 to 0.03%.

Carbon (C) is an element forming cementite, which forms pearlite having a layered structure together with ferrite, and C may be added in an amount of 0.01% or more to obtain strength of the wire rod of the present disclosure. Steel fibers are finished by wet drawing after dry drawing without performing LP heat treatment which is used to impart ductility by manufacturers. When the C content is excessive, a pearlite fraction exceeds 1%, thereby causing a problem of occurrence of fracture during the drawing process, and therefore an upper limit thereof may be controlled to 0.03%.

The content of Si is from 0.05 to 0.15%.

Silicon (Si) is an element hardening ferrite and improving strength. In the present disclosure, Si may be added in an amount of 0.05% or more to remove oxygen from molten steel. However, an excess of Si forms $Fe_2SiO_4$ having a high binding strength to a matrix, thereby deteriorating scale peeling property and causes a problem in that the probability of fracture increases during wet drawing due to hardening of ferrite. Therefore, an upper limit thereof is controlled to 0.15%.

The content of Mn is from 1.0 to 2.0%.

Manganese (Mn) is an element added to improve quenchability and to control S contained in steel and may be added in an amount of 1.0% or more to obtain strength of a wire rod via grain refinement. However, an excess of Mn may cause Mn segregation to increase the probability of fracture during the drawing process. Therefore, an upper limit thereof is controlled to 2.0%.

The content of P is from 0.05 to 0.15%.

Phosphorus (P) is generally segregated in grain boundaries in the case where the C content is high in steel or forms FeP in grain boundaries, thereby causing fracture during a drawing process. Thus, P is an element controlled as an impurity.

In the present disclosure, P having superior solid solution strengthening effect is added for compensation of strength in accordance with designing ultra-low carbon steel having a C content of 0.03wt % or less. P is a solid solution strengthening element that improves strength by about 90 MPa when added in an amount of 0.1 wt %. In the present disclosure, a target strength is obtained by adding 0.05 wt % or more of P. However, an excess of P makes it difficult to control segregation, and therefore an upper limit thereof is controlled to 0.15%.

The content of Al is 0.005% or less (excluding 0).

Aluminum (Al) is an element easily reacting with oxygen and added for deoxidation of a steel-making process. However, an excess of Al causes clogging of nozzles during a casting process due to inclusions, and particularly, forms hard inclusions such as $Al_2O_3$, thereby causing processing fracture during a drawing process. Therefore, an upper limit thereof is controlled to 0.005%.

The content of N is 0.01% or less (excluding 0).

Nitrogen (N) has a solid solution strengthening effect. However, when the N content is excessive, N binds to dislocation to increase aging strength, thereby deteriorating ductility and increasing manufacturing costs. Therefore, an upper limit thereof is controlled to 0.01%.

The content of S is 0.03% or less (excluding 0).

Sulfur (S), as an impurity that is inevitably contained in steels, forms MnS inclusions in grain boundaries to deteriorate workability. Therefore, an upper limit thereof is controlled to 0.03%.

The content of Sn is from 0.02 to 0.08%.

Tin (Sn), as an element having a high binding energy with dislocation, prevents binding of dislocation formed in ferrite during the drawing process to N and C, and therefore, an increase in strength of a material caused by dynamic and static aging may be prevented. To obtain the above-described effect, Sn is added in an amount of 0.02% or more in the present disclosure. However, an excess of Sn causes a problem in that manufacturing costs increase. Therefore, an upper limit thereof may be controlled to 0.08%.

The remaining component of the composition of the present disclosure is iron (Fe). However, the composition may include unintended impurities inevitably incorporated from raw materials or surrounding environments, and thus addition of other alloy components is not excluded. These impurities are known to any person skilled in the art of manufacturing and details thereof are not specifically mentioned in the present disclosure.

Meanwhile, a microstructure of the wire rod for a high-strength steel fiber according to an embodiment of the present disclosure is single-phase ferrite. Specifically, the wire rod includes ferrite in an area fraction of 99.5% or more. According to the present disclosure, in an ultra-low carbon steel having a C content of 0.03wt % or less, formation of the pearlite structure may be inhibited and ferrite is formed as a main structure of a steel, and thus fracture may be prevented during a drawing process.

In the present disclosure, in a grain boundary structure, grain boundaries are classified into high angle grain boundaries and low angle grain boundaries based misorientation between grain boundaries, and attempts have been made to control the average size of grains having the high angle grain boundaries. Specifically, relationships with neighboring grains are quantified as misorientation angles. Using 15° as a reference, the grain boundaries are classified into high angle grain boundaries and low angle grain boundaries.

To obtain strength of the wire rod, it is ideal to obtain a large amount of high angle grain boundaries by increasing a relative area of grain boundaries by reducing the grain size as much as possible. However, in order to reduce the grain size, there may be problems in that a rolling load increases to shorten a lifespan of a facility and productivity decreases.

Therefore, in the present disclosure, the average size of grains having he high angle grain boundaries with a misorientation angle of 15° or more is controlled at the central region of the wire rod. Specifically, according to the disclosed embodiment, in a −D/4 to D/4 range of a transverse cross-section of the wire rod, the area fraction of ferrite having an average grain size of 30 to 50 μm and high angle grain boundaries with a misorientation angle of 15° or more is from 60% to 80%. Here, D represents a diameter of the wire rod.

Although the surface of the wire rod has a low C content, the grain sizes vary due to non-uniform structure such as decarburized layer and scale. Thus, this embodiment is limited to the −D/4 to D/4 range having a relatively uniform structure. In addition, in the −D/4 to D/4 range of a transverse cross-section of the wire rod, an area fraction of ferrite having an average grain size greater than 50 μm and high angle grain boundaries with a misorientation angle of 15° or more may be 25% or less.

In addition, a tensile strength of the wire rod for a high-strength steel fiber according to an embodiment of the present disclosure may be 450 MPa or more.

Hereinafter, a method for manufacturing a wire rod for bearing steel fiber according to another embodiment of the present disclosure will be described in detail.

The wire rod of the present disclosure may be manufactured by preparing a billet having the above-described alloy composition, and performing a process of reheating-groove rolling-coiling-cooling.

The method for manufacturing a wire rod for a high-strength steel fiber according to another embodiment of the present disclosure include: preparing a wire rod by maintaining a billet including, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, in a furnace in a temperature range of 1,050 to 1,150° C. for 90 to 120 minutes and rolling the billet; coiling the prepared wire rod in a temperature range of 800 to 850° C.; and cooling the wire rod to 400° C. at a rate of 2 to 5° C./sec and cooling the wire rod to a temperature range of 180 to 220° C. at a rate of 20 to 30° C./sec.

First, the billet having the above-described composition is prepared and homogenization-heated into single-phase austenite.

In this case, the heating temperature may be controlled in the range of 1,050 to 1,150° C. In the present disclosure, the heating temperature of billet is set to 1,050° C. or higher to obtain a temperature range for the subsequent groove rolling and to obtain the single-phase austenite structure as a microstructure of the billet. Meanwhile, when the heating temperature is too high, surface quality may deteriorate due to scale formation and decarburization phenomenon and thus an upper limit of the heating temperature may be controlled to 1,150° C.

In addition, it is preferable to perform the heating for 90 minutes to 120 minutes. By performing the heating for 90 minutes or more, the solid solution strengthening element added to obtain strength may sufficiently form a solid solution. Meanwhile, when the heating time exceeds 120 minutes, a depth of a decarburized layer on the surface of the wire rod increases causing a problem in that the decarburized layer remains after the rolling is ended.

The heated billet is hot-rolled by sequentially performing rough rolling, intermediate rough milling/finish milling, and finish rolling to prepare a wire rod.

Then, a coiling process into a ring shape is performed. The coiling step of the present disclosure may be performed in a temperature range of 800 to 850° C.

When the coiling temperature is below 800° C., scale peeling property is poor due to a small thickness of scale. On the contrary, when the coiling temperature exceeds 850° C., a shape of the coil is not appropriate and the thickness of scale does not significantly increase. Therefore, it is preferable to perform the coiling process in the temperature range of 800 to 850° C.

After the coiling, a cooling method to minimize a residence time at a temperature below 400° C. is required to obtain amounts of solute N and solute P and to inhibit formation of FeP in grain boundaries.

For example, the coiled wire rod may be cooled to 400° C. at a rate of 2 to 5° C./sec. When the cooling rate is less than 2° C./sec in the cooling step, the temperature of the coil is still high while being stacked in a reforming tube and thus a worker may have difficulty in handling after the coil is transported to a test board and a subsequent process is required to cool the coil. On the contrary, a cooling rate exceeding 5° C./sec does not significantly contribute to enhancement of tensile strength but causes a problem of extra expenses (e.g., an increase in electricity charges) due to an increase in the amount of cooling.

Subsequently, the coil may be cooled to a temperature of 180 to 220° C. at a cooling rate of 20 to 30° C./sec. When the cooling rate is less than 20° C./sec, there are problems in that FeP is formed in grain boundaries present in central segregated region of the wire rod. On the contrary, when the cooling rate exceeds 30° C./sec, there are problems in that a cooling capacity of a facility is limited and thus an air blow exceeding the same is not applied and investment is required for the facility.

A microstructure of the cooled wire rod may include ferrite in an area fraction of 99.5% or more.

The wire rod for a high-strength steel fiber prepared in the above-described step may have a tensile strength of 450 MPa or more.

A high-strength steel fiber according to another embodiment of the present disclosure may be manufactured by drawing the prepared wire rod for a high-strength steel fiber.

A method for manufacturing a high-strength steel fiber according to another embodiment of the present disclosure includes: dry-drawing the wire rod for a high-strength steel fiber; and wet-drawing the wire rod to a diameter of 0.4 to 1.0 mm.

The steel wire for a steel fiber may have a tensile strength of 1,500 MPa in a state where a total reduction ratio is 92.4% after the dry drawing and wet drawing.

As described above, the wire rod for a high-strength steel fiber according to the present disclosure includes ferrite as a main structure and fracture of the steel wire occurring during the wet-drawing after the dry-drawing may be prevented even without performing LP heat treatment.

In addition, a tensile strength of 1,500 MPa or more corresponding to a level required for conventional steel wires for steel fibers may be obtained by adjusting the composition ratio of C, N, P, and Sn.

In the high-strength steel fiber manufactured according to the present disclosure, a number of torsions without delamination is 60 times or more, based on a length of 100 D, and thus excellent torsional properties may be obtained.

Hereinafter, the present disclosure will be described in more detail through examples. However, it is necessary to note that the following examples are only intended to illustrate the present disclosure in more detail and are not intended to limit the scope of the present disclosure. This is because the scope of the present disclosure is determined by matters described in the claims and able to be reasonably inferred therefrom.

EXAMPLES

Steels satisfying the alloy compositions shown in Table 1 were manufactured in a converter and cast (1.8 m/min) under the conditions commonly used in the art to prepare continuous cast billets (cross-section: 160*160 $mm^2$). Subsequently, the billets were maintained in a furnace at a temperature of 1,090° C. for 90 minutes and groove rolled into a wire diameter of 5.5 mm. Then, the rolled wire rod was coiled at 850° C. and cooled to 400° C. at a rate of 3° C./s, and uniformly cooled to 200° C. at a rate of 23° C./s to inhibit formation of FeP . After removing some of scales present on the surface of the manufactured wire rod by using a mechanical peeling method, the wire rod was dry-drawn at a rate of 2.0 m/s.

TABLE 1

| (wt %) | C | P | Mn | Sn | Si | Al | N | S |
|---|---|---|---|---|---|---|---|---|
| Example 1 | 0.020 | 0.120 | 1.500 | 0.050 | 0.100 | 0.005 | 0.008 | 0.020 |
| Example 2 | 0.020 | 0.120 | 1.800 | 0.049 | 0.120 | 0.005 | 0.007 | 0.022 |
| Example 3 | 0.021 | 0.110 | 1.520 | 0.030 | 0.100 | 0.005 | 0.007 | 0.022 |
| Example 4 | 0.023 | 0.110 | 1.500 | 0.080 | 0.120 | 0.003 | 0.006 | 0.021 |
| Comparative Example 1 | 0.008 | 0.110 | 1.510 | 0.050 | 0.110 | 0.004 | 0.007 | 0.023 |
| Comparative Example 2 | 0.035 | 0.110 | 1.500 | 0.049 | 0.110 | 0.004 | 0.008 | 0.023 |
| Comparative Example 3 | 0.021 | 0.040 | 1.510 | 0.051 | 0.110 | 0.004 | 0.007 | 0.021 |
| Comparative Example 4 | 0.022 | 0.210 | 1.500 | 0.050 | 0.120 | 0.005 | 0.007 | 0.022 |
| Comparative Example 5 | 0.021 | 0.110 | 0.800 | 0.049 | 0.110 | 0.004 | 0.008 | 0.020 |
| Comparative Example 6 | 0.022 | 0.120 | 2.100 | 0.048 | 0.100 | 0.004 | 0.007 | 0.019 |
| Comparative Example 7 | 0.020 | 0.120 | 1.490 | 0.010 | 0.110 | 0.004 | 0.008 | 0.020 |
| Comparative Example 8 | 0.020 | 0.130 | 1.520 | 0.100 | 0.110 | 0.004 | 0.007 | 0.023 |
| Comparative Example 9 | 0.021 | 0.120 | 1.500 | 0.052 | 0.200 | 0.005 | 0.006 | 0.020 |

TABLE 1-continued

| (wt %) | C | P | Mn | Sn | Si | Al | N | S |
|---|---|---|---|---|---|---|---|---|
| Comparative Example 10 | 0.021 | 0.110 | 1.520 | 0.049 | 0.120 | 0.020 | 0.007 | 0.019 |

Then, tensile strengths of the prepared wire rods of the examples and comparative examples, area fractions of ferrite in a cross-section of each wire rod, specifically, in a −D/4 to D/4 range of a transverse cross-section, based on average grain size, and whether pearlite was formed are shown in Table 2. In addition, tensile strengths of the dry-drawn wire rods of the examples and comparative examples are show in Table 2.

Subsequently, the dry-drawn wire rod was wet-drawn under the condition of a processing amount of 92.4%. In this regard, whether fracture occurred during wet drawing was shown in Table 2.

As conditions for EB SD analysis, when a tolerance was set to 15° and a step interval was set to 0.1 um, sizes of ferrite having orientations <001>, <010>, and <100> were measured in the −D/4 to +D/4 range.

TABLE 2

| | | In -D/4 to D/4 of cross-section of wire rod | | | | |
|---|---|---|---|---|---|---|
| | Tensile strength of wire rod (MPa) | Fraction of ferrite having grain size of 30 to 50 μm (%) | Fraction of ferrite having grain size greater than 50 μm (%) | Formation of pearlite | Tensile strength of dry-drawn wire rod (MPa) | Occurrence of fracture |
| Example 1 | 480 | 62 | 18 | No | 1060 | No |
| Example 2 | 500 | 60 | 17 | No | 1130 | No |
| Example 3 | 470 | 62 | 16 | No | 1080 | No |
| Example 4 | 480 | 64 | 19 | No | 1090 | No |
| Comparative Example 1 | 430 | 53 | 24 | No | 930 | No |
| Comparative Example 2 | 550 | 49 | 19 | Yes | 1140 | Yes |
| Comparative Example 3 | 420 | 61 | 19 | No | 1020 | no |
| Comparative Example 4 | 580 | 62 | 20 | No | 1210 | Yes |
| Comparative Example 5 | 420 | 60 | 19 | No | 1050 | no |
| Comparative Example 6 | 590 | 49 | 18 | No | 1220 | Yes |
| Comparative Example 7 | 490 | 64 | 18 | No | 1100 | No |
| Comparative Example 8 | 490 | 63 | 20 | No | 1080 | No |
| Comparative Example 9 | 495 | 62 | 21 | No | 1070 | Yes |
| Comparative Example 10 | 480 | 60 | 20 | No | 1060 | Yes |

Tensile strengths and torsional properties of the wet-drawn wire rods of the examples and comparative examples are shown in Table 3 below. In Table 3 below, x indicates a case in which fracture occurred during wet drawing.

The torsion test was performed using a universal torsion tester (back load: fracture stress×0.2), and a length of a test material was set to 100 D (D: diameter of steel wire).

TABLE 3

| | Tensile strength of wet-drawn wire rod | | | | Strength by increase | Torsion of wet-drawn wire rod | Torsion of wet-drawn wire rod |
|---|---|---|---|---|---|---|---|
| | (After 1 hr)-a | (After 6 hr)-b | (After 12 hr)-c | (After 24 hr)-d | in aging (d-a) | (times) 1 hr aging | (times) 24 hr aging |
| Example 1 | 1530 | 1550 | 1560 | 1560 | 30 | 66 | 64 |
| Example 2 | 1610 | 1640 | 1650 | 1650 | 40 | 63 | 60 |
| Example 3 | 1540 | 1570 | 1580 | 1580 | 40 | 65 | 63 |
| Example 4 | 1540 | 1560 | 1570 | 1570 | 30 | 66 | 65 |
| Comparative Example 1 | 1410 | 1450 | 1460 | 1460 | 50 | 69 | 68 |
| Comparative Example 2 | x | x | x | x | x | x | x |
| Comparative Example 3 | 1460 | 1490 | 1520 | 1520 | 60 | 67 | 66 |

TABLE 3-continued

| | Tensile strength of wet-drawn wire rod | | | | Strength by increase | Torsion of wet-drawn wire rod | Torsion of wet-drawn wire rod |
|---|---|---|---|---|---|---|---|
| | (After 1 hr)-a | (After 6 hr)-b | (After 12 hr)-c | (After 24 hr)-d | in aging (d-a) | (times) 1 hr aging | (times) 24 hr aging |
| Comparative Example 4 | x | x | x | x | x | x | x |
| Comparative Example 5 | 1460 | 1480 | 1490 | 1510 | 50 | 67 | 65 |
| Comparative Example 6 | x | x | x | x | x | x | x |
| Comparative Example 7 | 1590 | 1670 | 1700 | 1710 | 120 | 61 | 40 |
| Comparative Example 8 | 1550 | 1580 | 1580 | 1580 | 30 | 67 | 60 |
| Comparative Example 9 | x | x | x | x | x | x | x |
| Comparative Example 10 | x | x | x | x | x | x | x |

Referring to Tables 1 to 3, in the wire rods of Examples 1 to 4 satisfying the alloy composition according to the present disclosure, perlite causing fracture during a drawing process was not formed, and the area fraction of ferrite having an average grain size of 30 to 50 μm and high angle grain boundaries with a misorientation angle of 15° or more was 60% or more, and thus a tensile strength is 450 MPa or more was obtained.

Also, in the case of Examples 1 to 4, the tensile strength of each final steel wire was not less than 1,500 MPa even when the LP heat treatment was not performed after the dry drawing and before the wet drawing, and the number of torsions without delamination was not less than 60 based on the length of 100 D (D is a diameter of each steel wire), and thus steel wires may be applied to products manufactured by twisting the steel wires.

In addition, because an increase in tensile strength after 24 hours of room temperature aging was not more than 40 MPa and a reduction in the number of torsions after 24 hours of room temperature aging was twice or less in the case of Examples 1 to 4, and thus safety problems occurring as a result of static aging may be solved.

Comparative Example 1 shows a case in which a sufficient tensile strength of the wire rod and the final steel wire was not obtained due to the low C content. On the contrary, in the case of Comparative Example 2, the C content of 0.035% exceeded the upper limit of 0.03% suggested in the present disclosure, and thus pearlite was formed and fracture occurred during wet drawing.

In the case of Comparative Example 3, the P content of 0.04% was below the lower limit of 0.05% suggested by the present disclosure, and thus the tensile strength of the final steel wire could not reach the target value of 1500 MPa.

In the case of Comparative Example 4, the P content of 0.21% exceeded the upper limit of 0.15% suggested by the present disclosure, and thus P segregation occurred in grain boundaries and ferrite hardness increased, thereby causing fracture during wet drawing.

In the case of Comparative Example 5, the Mn content of 0.8% was below the lower limit 1.0% suggested by the present disclosure, and thus the tensile strength of the final steel wire could not reach the target value of 1500 MPa.

In the case of Comparative Example 6, the Mn content of 2.1% exceeded the upper limit of 2.0% suggested by the present disclosure, and thus Mn segregation occurred, thereby causing fracture during wet drawing.

The effects of addition of Sn, which is a major element of the present disclosure, may be confirmed in Comparative Example 7 and Comparative Example 8. Referring to Table 2, because Sn does not affect strength, there is no difference between the strengths of the wire rod and the dry-drawn wire rod. However, in Comparative Example 7, the Sn content of 0.01% is far lower than the lower limit of 0.02% suggested by the present disclosure, and thus the tensile strength considerably increased from 1590 MPa to 1710 MPa and the number of torsions considerably decreased from 61 times to 40 times during the room temperature aging after the final wet drawing. Therefore, reliability of mechanical properties in consideration of aging phenomenon could not be obtained.

In Comparative Example 9, the Si content of 0.2% exceeded the upper limit of 0.15% suggested by the present disclosure, and thus fracture occurred during wet drawing due to the increase in ferrite hardness.

In Comparative Example 10, the Al content of 0.02% exceeded the upper limit of 0.005% suggested by the present disclosure, and thus hard inclusions were formed and fracture occurred during wet drawing.

While the present disclosure has been particularly described with reference to exemplary embodiments, it should be understood by those of skilled in the art that various changes and modifications in form and details may be made without departing from the spirit and scope of the present disclosure.

INDUSTRIAL APPLICABILITY

The wire rod according to the present disclosure may have a strength of 1,500 MPa or more even with a low C content, and the LP heat treatment that is a process of recovering ductility during drawing may be omitted, and thus manufacturing costs may be reduced and the wire rod may be used as a material for steel fibers.

The invention claimed is:

1. A wire rod for a high-strength steel fiber comprising, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, wherein a microstructure comprises 99.5% or more of ferrite phase by area fraction, wherein, in a −D/4 to D/4 range of a transverse cross-section, an area fraction of ferrite having an average grain size of 30 to 50 μm and high angle grain boundaries with a misorientation angle of 15° or more is from 60 to 80%, and wherein D represents a diameter of the wire rod.

2. The wire rod according to claim 1, wherein, in the −D/4 to D/4 range of the transverse cross-section, an area fraction of ferrite having an average grain size greater than 50 μm and high angle grain boundaries with a misorientation angle of 15° or more is 25% or less.

3. The wire rod according to claim 1, wherein the microstructure is single phase ferrite.

4. The wire rod according to claim 1, wherein a tensile strength is 450 MPa or more.

5. A method for manufacturing the wire rod of claim 1, the method comprising:

preparing a first wire rod by maintaining a billet comprising, in percent by weight (wt %), 0.01 to 0.03% of C, 0.05 to 0.15% of Si, 1.0 to 2.0% of Mn, 0.05 to 0.15% of P, 0.005% or less (excluding 0) of Al, 0.01% or less (excluding 0) of N, 0.03% or less (excluding 0) of S, 0.02 to 0.08% of Sn, and the remainder of Fe and inevitable impurities, in a furnace in a temperature range of 1,050 to 1,150° C. for 90 to 120 minutes and rolling the billet;

coiling the prepared first wire rod in a temperature range of 800 to 850° C.; and cooling the coiled wire rod to 400° C. at a rate of 2 to 5° C./sec and cooling the cooled wire rod to a temperature range of 180 to 220° C. at a rate of 20 to 30° C./sec.

6. A method for manufacturing a high-strength steel fiber, the method comprising:

dry-drawing the wire rod for a high-strength steel fiber according to claim 1; and wet-drawing the wire rod to a diameter of 0.4 to 1.0 mm, wherein a tensile strength of 1,500 MPa or more is obtained without performing LP heat treatment after the dry-drawing and before the wet-drawing.

7. A method for manufacturing a high-strength steel fiber, the method comprising:

dry-drawing the wire rod for a high-strength steel fiber according to claim 2;

and wet-drawing the wire rod to a diameter of 0.4 to 1.0 mm, wherein a tensile strength of 1,500 MPa or more is obtained without performing LP heat treatment after the dry-drawing and before the wet-drawing.

8. A method for manufacturing a high-strength steel fiber, the method comprising:

dry-drawing the wire rod for a high-strength steel fiber according to claim 3;

and wet-drawing the wire rod to a diameter of 0.4 to 1.0 mm, wherein a tensile strength of 1,500 MPa or more is obtained without performing LP heat treatment after the dry-drawing and before the wet-drawing.

* * * * *